US007468025B2

(12) United States Patent
Hauser et al.

(10) Patent No.: US 7,468,025 B2
(45) Date of Patent: Dec. 23, 2008

(54) PUSH-UP EXERCISE UNIT AND DEVICE

(75) Inventors: Stephen G. Hauser, Tarzana, CA (US); Mark B. Friedman, Simi Valley, CA (US); Alden M. Mills, Kentfield, CA (US)

(73) Assignee: Perfect Pushup, LLC, Mill Valley, CA (US)

( * ) Notice: Subject to any disclaimer, the term of this patent is extended or adjusted under 35 U.S.C. 154(b) by 0 days.

(21) Appl. No.: 11/996,152

(22) PCT Filed: Jun. 28, 2007

(86) PCT No.: PCT/US2007/072394

§ 371 (c)(1),
(2), (4) Date: Jan. 18, 2008

(87) PCT Pub. No.: WO2008/003057

PCT Pub. Date: Jan. 3, 2008

(65) Prior Publication Data

US 2008/0200318 A1 Aug. 21, 2008

(51) Int. Cl.
*A63B 71/00* (2006.01)

(52) U.S. Cl. ..... 482/141; 482/62

(58) Field of Classification Search ..... 482/44–50, 482/62, 115, 135–137, 141, 146–148, 910; D21/662, 665; 16/DIG. 24
See application file for complete search history.

(56) References Cited

U.S. PATENT DOCUMENTS 938,348 A * 10/1909 Stull ..... 482/49
3,100,639 A * 8/1963 Bonewitz ..... 482/147
3,115,338 A * 12/1963 Acs et al. ..... 482/141
3,454,273 A * 7/1969 Vogt ..... 482/147
3,730,521 A * 5/1973 Sellman ..... 482/147
4,226,412 A * 10/1980 Panepinto ..... 482/49
4,351,525 A * 9/1982 Rozenblad ..... 482/141
4,358,106 A 11/1982 Shadford
4,610,448 A 9/1986 Hill
4,663,802 A * 5/1987 Kunzler ..... 16/408
4,768,778 A 9/1988 Thomas, Jr.
4,858,912 A 8/1989 Boyd ..... 999/67
4,858,916 A * 8/1989 Beaumont ..... 482/105
4,905,540 A * 3/1990 Hughes et al. ..... 74/579 E
5,167,596 A * 12/1992 Ferber ..... 482/46
5,226,868 A * 7/1993 Montgomery ..... 482/141

(Continued)

*Primary Examiner*—Loan H Thanh
*Assistant Examiner*—Daniel F Roland
(74) *Attorney, Agent, or Firm*—Charter Advisory Partners, LLC; Matthew J. Lattig

(57) ABSTRACT

A push-up exercise unit and device is described which may enable a user to move with his/her body's natural rotation to engage additional muscle groups with reduced stress on joints. The device can include a handle support structure having a pair of columns between a lower base and a separate end cap such that the handle intersects a corresponding end cap and upper portion of a corresponding column of the handle support structure. The device includes a fixed base support attached to the handle support structure, and a bearing assembly to permit rotation of the contiguous handle, end caps and handle support structure by a user with the base support resting on a planar surface. In another example, the handle assembly is detachable from a first surface on the handle support structure and inserted into a second surface to facilitate stowage for travel.

12 Claims, 11 Drawing Sheets

U.S. PATENT DOCUMENTS

| | | | | |
|---|---|---|---|---|
| 5,358,463 | A | 10/1994 | Fuentes | 482/141 |
| 5,632,707 | A | 5/1997 | Daniel et al. | 482/8 |
| 5,713,823 | A * | 2/1998 | Walendzak et al. | 482/142 |
| 5,766,119 | A * | 6/1998 | Clark | 482/146 |
| 6,129,651 | A * | 10/2000 | Denaro | 482/141 |
| 6,186,930 | B1 * | 2/2001 | Ignaczak | 482/141 |
| D523,493 | S * | 6/2006 | Horton | D21/662 |
| 7,063,646 | B1 * | 6/2006 | Slimi | 482/45 |
| 7,377,888 | B2 * | 5/2008 | Godbold | 482/141 |
| D576,693 | S * | 9/2008 | Khubani | D21/686 |
| 2003/0216221 | A1 * | 11/2003 | Iverson | 482/51 |
| 2004/0266593 | A1 | 12/2004 | Schwendeman | |
| 2006/0014615 | A1 | 1/2006 | Godbold | 482/141 |
| 2006/0035771 | A1 | 2/2006 | Gant | 482/141 |
| 2006/0040809 | A1 | 2/2006 | Godbold | 482/141 |
| 2007/0184951 | A1 * | 8/2007 | James et al. | 482/141 |

* cited by examiner

PUSH-UP EXERCISE UNIT AND DEVICE

BACKGROUND

Example embodiments in general relate to a push-up exercise unit and device for use in performing a push-up type exercise.

Push-ups are one of the oldest and perhaps most effective exercises for a human being. The push-up exercise is employed by the military and competitive sports teams around the world to gauge overall fitness. Conventional push-ups however, with the hands placed directly on a non-movable hard surface such as a floor, have limitations. Conventional push-ups place stress on wrists, elbows and shoulders, and prevent the natural rotation of muscles and joints.

SUMMARY

An example embodiment is directed to a push-up exercise unit and device. The device can include a handle support structure having a pair of columns between a lower base and a separate end cap such that the handle intersects a corresponding end cap and upper portion of a corresponding column of the handle support structure. The device includes a fixed base support attached to the handle support structure, and a bearing assembly to permit rotation of the contiguous handle, end caps and handle support structure by a user with the base support resting on a planar surface. In another example, the handle assembly is detachable from a first surface on the handle support structure and inserted into a second surface to facilitate stowage for travel.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION OF EXAMPLE EMBODIMENTS

Figure 1:
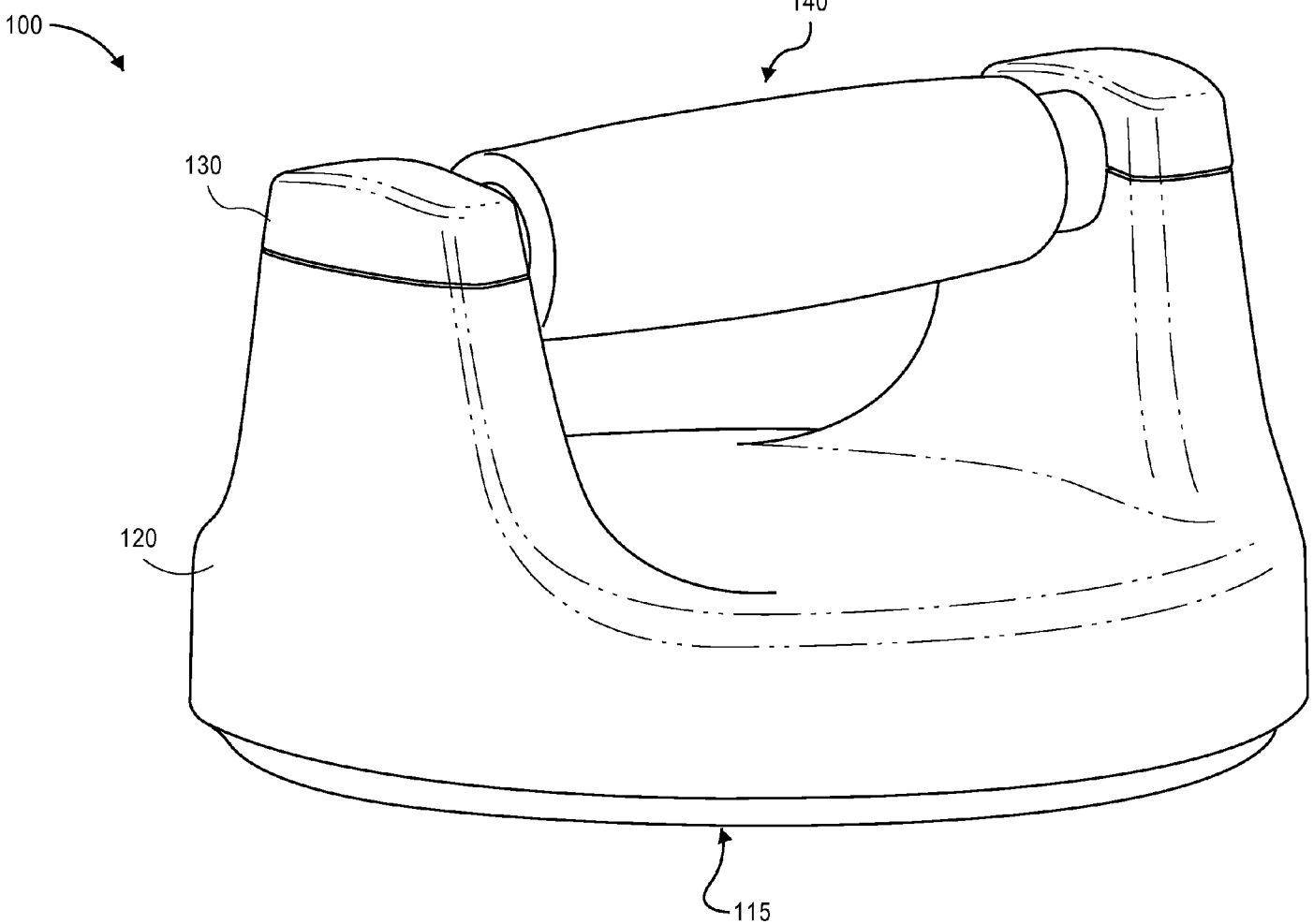
FIG. 1 is perspective view of one exercise device 100 of a pair of devices which comprise a push-up unit, in accordance with an example embodiment.

FIG. 1 is perspective view of one exercise device 100 of a pair of exercise devices which comprise a push-up unit, in accordance with an example embodiment. Referring to FIG. 1, a singular push-up device, hereafter 'device 100' includes a base support 115 which is immediately connected to a main handle support structure 120 via a plurality of interior fasteners such as screws. In practice, a complete push-up unit includes a pair of devices 100, one for each hand, as is known. In each device 100, the handle support structure 120 is operatively connected to a pair of end caps 130. A handle assembly 140 is provided in a cavity or circular aperture formed between the intersections of the end caps 130 and the handle support structure 120.

In general, the housing of device 100, inclusive of base support 115, handle support structure 120 and the separate end caps 130, can be formed by an injection molding process from a medium or heavy gauge impact plastic such as acrylonitrile butadiene styrene (ABS). ABS is an easily machined, tough, low-cost, rigid thermoplastic material with medium to high impact strength, and is a desirable material for turning, drilling, sawing, die-cutting, shearing, etc.

Each of the base support 115, main handle support structure 120 and end caps 130 may be made of ABS. ABS is merely one example material; equivalent materials include various thermoplastic and thermoset materials that have characteristics similar to ABS. For example, polypropylene, high-strength polycarbonates such as GE Lexan, and/or blended plastics may be used instead of, or in addition with ABS. The materials comprising device 100 (plastic such as ABS, rubber and lightweight metal materials) provide a light yet durable exercise device 100.

An exemplary injection molding system for forming molded plastic articles included in device 100 may be the Roboshot® injection machine from Milacron-Fanuc. The Roboshot is one of many known injection molding machines for forming plastic injection molds.

Figure 2:
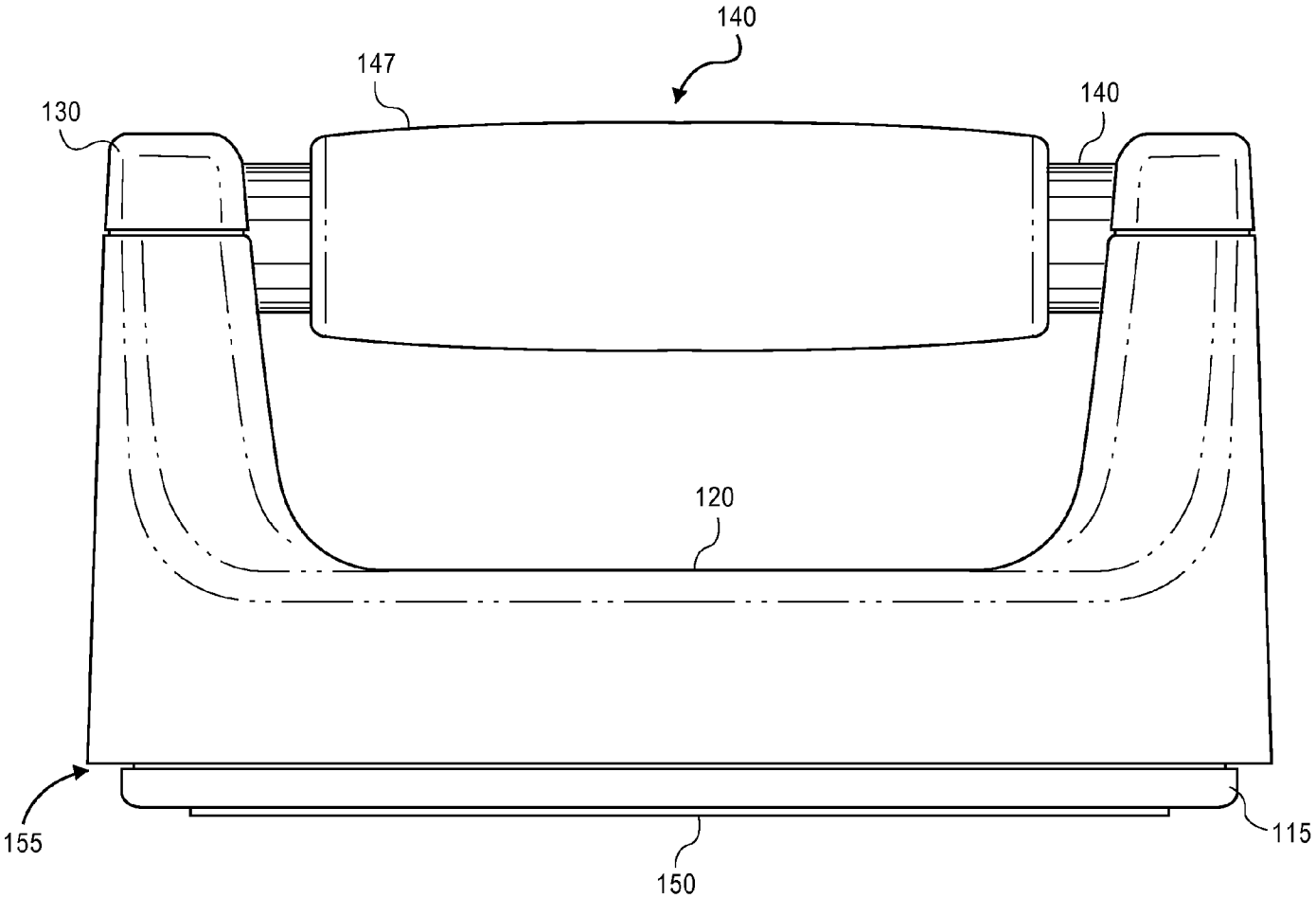
FIG. 2 is a front view of the device 100.

FIG. 2 is a front view of the device 100. Device 100 includes a handle assembly 140. The handle assembly 140 comprises a chrome steel handle-rod 145 overlaid with or sheathed within a grip 147. The handle-rod 145 may alternatively be comprised of an aluminum hollow member and is received within corresponding recesses (not shown) formed in the end caps 130 and handle support structure 120 which, when aligned, form a circular aperture around each handle end. The grip 147 may be made of a foam rubber or suitable elastomeric material and has a wider or thicker center portion which tapers down to the end portions of grip 147.

Device 100 includes a solid rubber gripping surface configured as a rubberized pad 150. Pad 150 is provided on the underside of the base support 115. The pad 150 offers a friction surface when the device 100 is resting on a flat surface. The pad 150 may be adhered to the underside of the base support 115 via suitable epoxy or adhesive, for example. The non-skid rubber pad 150 grips well on carpet and hard floor surfaces.

A gap 155 is provided between the handle support structure 120 and the base support 115 to assist in permitting rotational movement of the contiguous handle support structure 120 with end caps 130 and handle assembly 140, ostensibly by providing clearance for a bearing assembly, while the base support 115 remains fixed in place. In this example, the rotational movement is facilitated by a turntable or "Lazy Susan" bearing assembly within the device 100, which is interposed between the main handle support structure 120 and base support 115. Thus, the gap 155 provided between the housing of the handle support structure 120 and base support 115 permits collective rotational movement of the contiguous upper portion of the device 100: handle support structure 120, end caps 130 and handle assembly 140.

Figure 3:
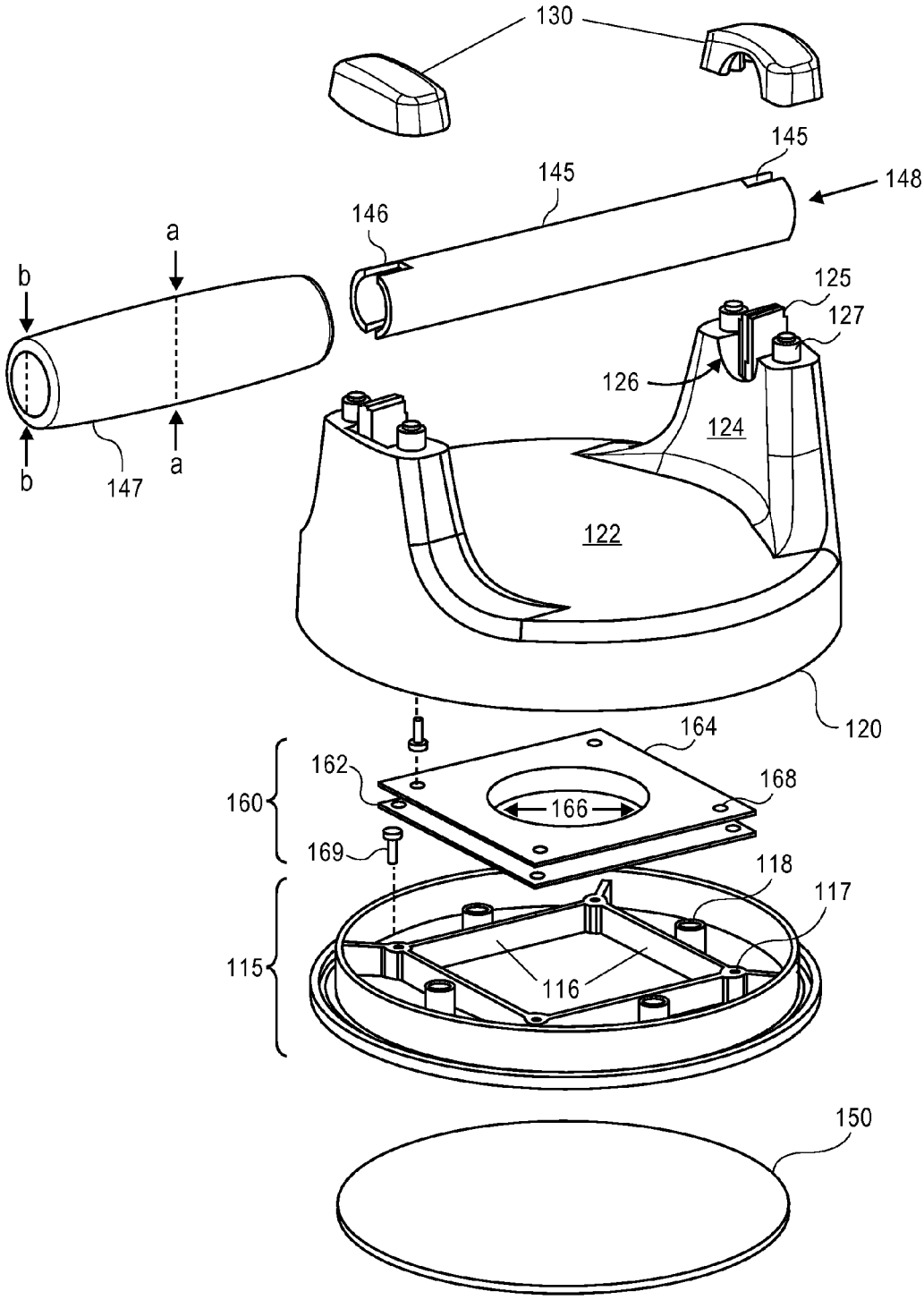
FIG. 3 is an exploded view of the device 100 to illustrate constituent components thereof in greater detail.

FIG. 3 is an exploded view of the device 100. As shown in FIG. 3, the handle assembly 140 includes the elongated handle-rod 145 which has chamfers 146 at ends thereof. The handle-rod 145 is hollow as shown by arrow 148. In an example, the width "a" at central portion of the grip 147 is wider or thicker at a diameter thereof then width "b" at ends thereof. This is to better conform to the user's hand to facilitate grasping the handle assembly 140 of the device 100.

FIG. 3 also illustrates the handle support structure 120 in further detail. For purposes of clarity, the end caps 130 in FIG. 3 have been removed. The handle support structure 120 includes lower base 122 and two formed columns 124 which slope upward from the lower base 122. A recess 126 having a generally semi-circular surface is formed in each column 124. In each column 124, a stanchion 125 is located generally in the center of its corresponding recess 126 for mating engagement with the chamfers 146 of the handle-rod 145. The top portion of each column 124 includes a pair of posts 127 for mating engagement within corresponding bores (not shown, characterized as crevices within the underside of the end caps 130).

With continued reference to FIG. 3, the device 100 includes a steel or hard plastic ball-bearing rotational system. In an example, this system may be embodied as a turntable to allow rotation of movement of device 100. In particular, the turntable permits rotation between the upper portion of the device 100 and the base support 115.

Referring to FIG. 3, there is shown a square "Lazy Susan" turntable 160. The turntable 160 comprises two connected parts, a lower fixed plate 162 and an upper rotatable plate 164. A bearing assembly, indicated generally by arrows 166 surrounding a race (center circumferential opening) within the turntable 160 is provided between the lower fixed plate 162 and upper rotatable plate 164. These bearings are not shown for purposes of clarity.

In an example, the turntable 160 may be made of lightweight stamped aluminum plates with stainless steel ball bearings therein. For example, the turntable may be a 6"×6" square turntable fabricated by McMaster-Carr, part number 6031K18. However, the example embodiments are not limited to aluminum turntable plates, as galvanized steel, black chromate and yellow chromate are also acceptable materials for the turntable.

With continued reference to FIG. 3, the base support 115 includes an interior structure shown as a molded element 116. Molded element 116 includes a bore hole 117 at each corner thereof for receiving suitable fasteners 169 such as self-tipped screws which connect lower fixed plate 162 of the turntable 160 to the base support 115. The base support 115 includes a plurality of spacers 118 for clearance and hence to generate the gap 155 between the base support 115 and handle support structure 120. A plurality of bores 168 are formed through both the lower fixed plate 162 and upper plate 164 to enable fasteners 169 to matingly engage an underside of the handle support structure 120, enabling the upper portion of device 100 to rotate as a contiguous unit with the upper plate 164.

Figure 4A:
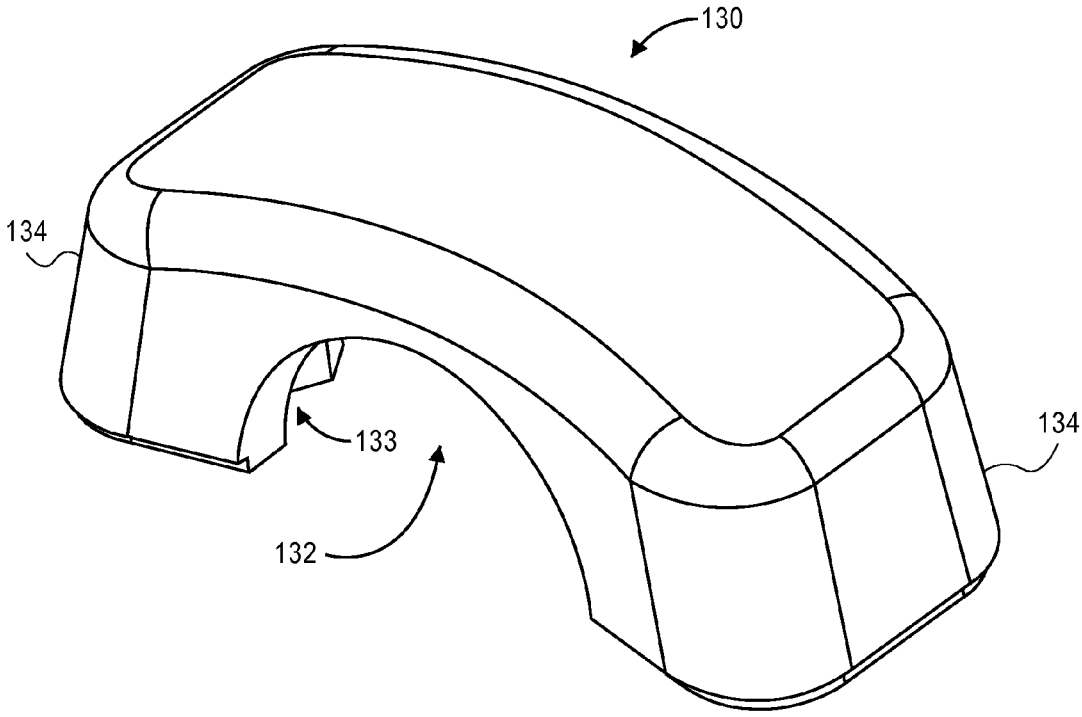
FIG. 4A is a perspective view of the end cap 130.
Figure 4B:
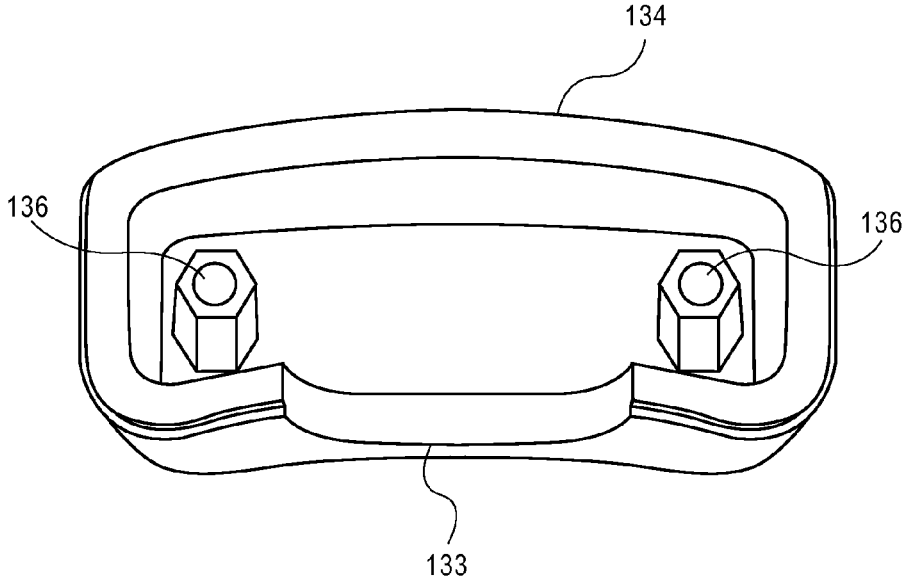
FIG. 4B is an interior view of a column 134 portion of the end cap 130.
Figure 5:
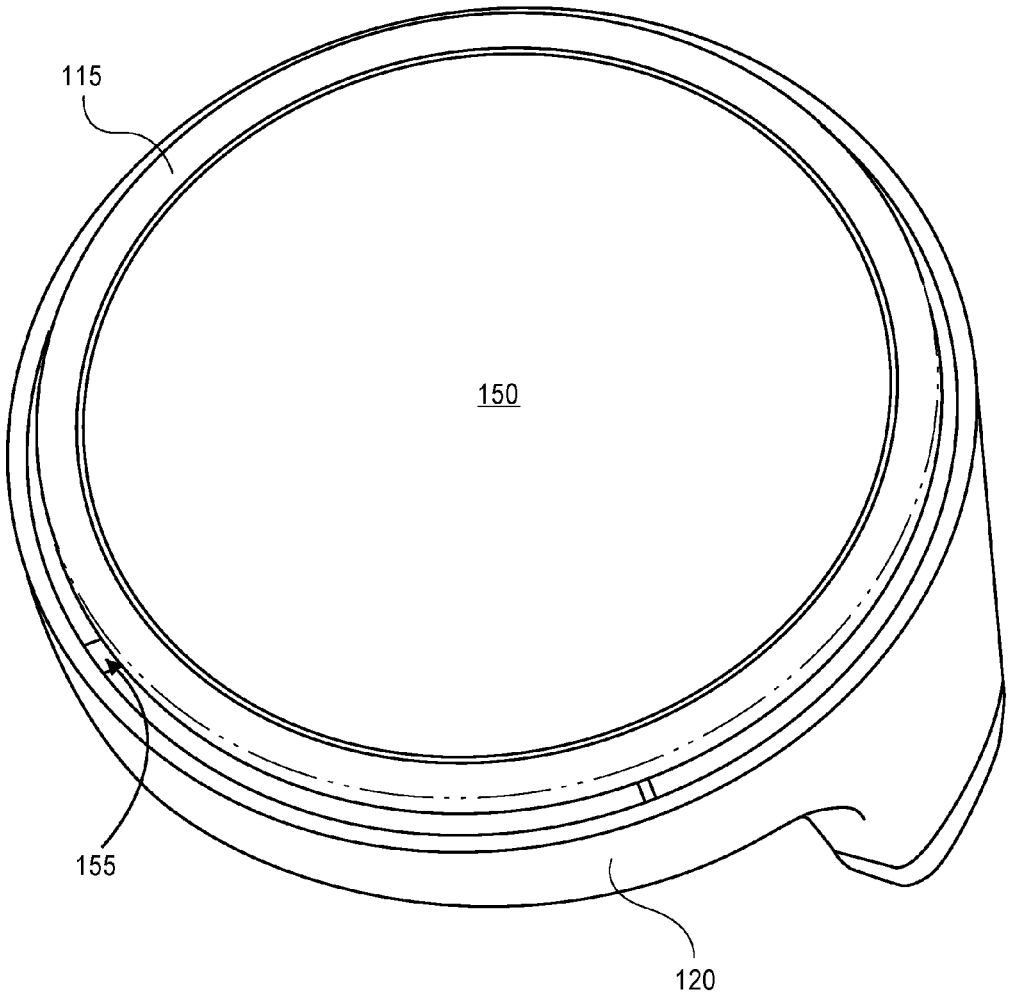
FIG. 5 is an underside view of the device 100 to illustrate the rubberized pad 150 in further detail.

FIG. 4A is a perspective view of the end cap 130; FIG. 4B is an interior view of a column 134 portion of the end cap 130. Each end cap 130 has a semi-circular arc 132 at a central grasping portion thereof and extends down to a pair of columns 134 which minimally engage the columns 124 of the handle support structure 120 via the post 126 and interior bores 136 within the underside of end cap 130. As can be seen in FIG. 4B, there is a provided a semi-circular recess 133 on the interior underside of each column 134 which, when connected to the columns 124 of the handle support structure 120, forms the circular opening for receiving the handle-rod 145. As best shown in FIG. 4B, the bores 136 receive the posts 127 from the handle support structure 120 as previously shown in FIG. 3, for example.

Use of device 100 may benefit a workout by imparting rotational movement to force various hand/shoulder orientations, enabling the user to exercise different parts of the arms and shoulders, as well as the upper and lower back. The revolving turntable 160 provides clean rotational movement, since the ball bearings housed in a generally large circular race have a space saving design which is approximately only about 5/16" high. As an alternative, notches or detents could be provided on the outer circumferential surface of the rotating plate of the turntable 160 to give a repeatable position capability to the user of the device 100.

The example device 100 allows the user's arms to rotate naturally during the push-up in much the same way as when the user throws a punch or presses up a dumbbell. This accelerates results by engaging more muscles and reducing strain on the joints—potentially maximizing the user's workout. The rotating base supports 115 thus permit the user's muscles to rotate through its natural arc. Examples of such natural arc of movement include throwing a punch, swinging a golf club or pressing dumbbells, for example.

Accordingly, the incorporation of the smooth, ball bearing action of the handle assemblies 140/handle support structure 120 on the non-skid base support 115 facilitate the user's workout on any hard floor surface or carpet. The example device 100 may thus enable the user to move with his or her body's natural rotation, so as to engage additional muscle groups with reduced stress on the user's joints, as compared to the conventional push-up exercise.

Figure 6:
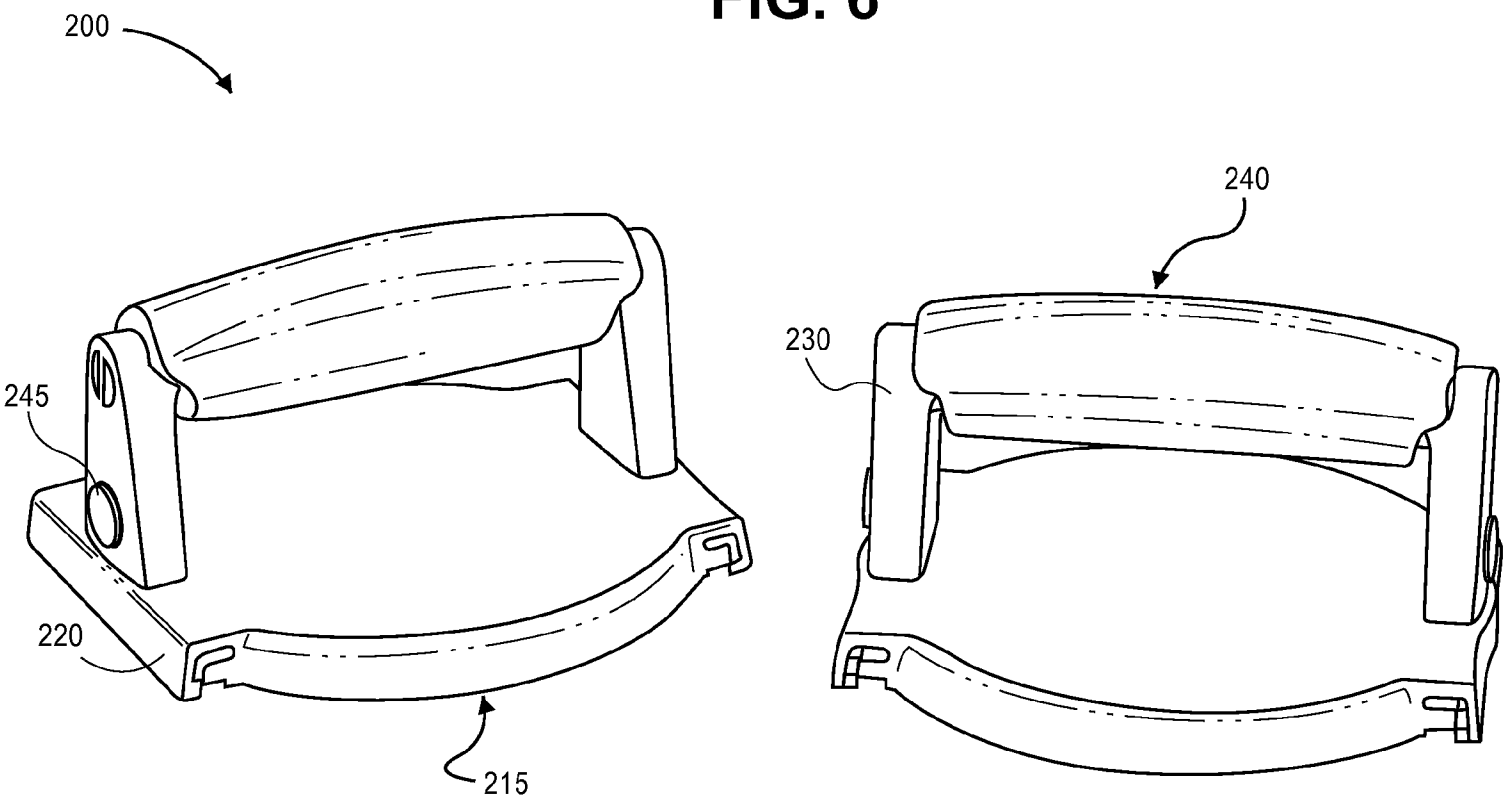
FIG. 6 is perspective view of an exercise device 200 in accordance with another example embodiment.

FIG. 6 is perspective view of an exercise device 200 in accordance with another example embodiment. Device 200, shown as a pair ("push-up unit"), is similar to device 100 as shown in FIGS. 1-5; thus only the differences will be described in detail hereafter for sake of brevity. Each device 200 includes a handle assembly 210 comprising a handle 240 attached between a pair of support arms 230. The handle 240 may be fabricated from a solid rod of steel, aluminum or plastic, for example.

Each of the base support 215, handle support structure 220 and support arms 230 may be made of ABS or another thermoplastic and/or thermoset material having characteristics similar to ABS, such as polypropylene, high-strength polycarbonates such as GE Lexan, and/or blended plastics. These equivalent materials can be used in lieu of or in addition to ABS. The handle 240 may be a steel or chrome rod sheathed with a suitable rubber or plastic grip 247. The handle support structure 220 envelops a base support 215. The fixed base support 215 has a non-skid pad 250 on an underside thereof, similar to device 100.

Unlike device 100, each handle assembly 210 is readily detachable via a release mechanism 245 from its corresponding handle support structure 220 at a first location on an lower base 222 thereof, to be re-attached at a second location on the push-up unit so as to couple the two base supports 215 together as a tight package formed within the two base support structures 220, which mate with each other and which are secured by a locking action of the two handle assemblies 210 into the front and rear facings 225 of each handle support structure 220.

Figure 7A:
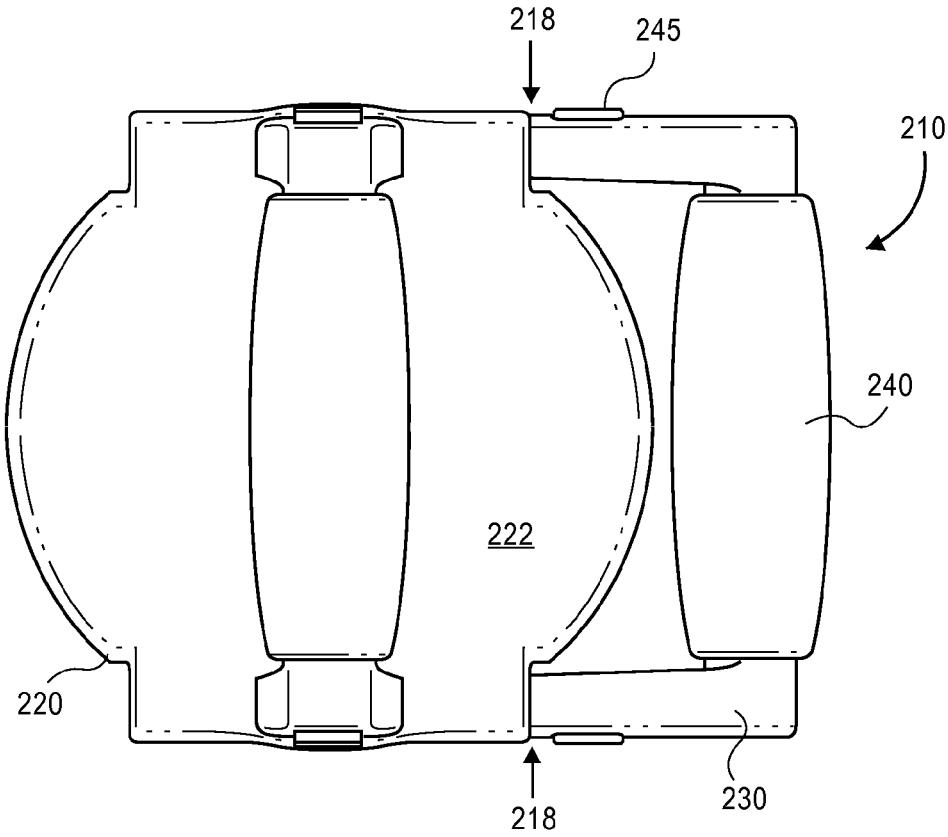
FIG. 7A is a top view showing how a handle 240 is configured in preparation for storage.
Figure 7B:
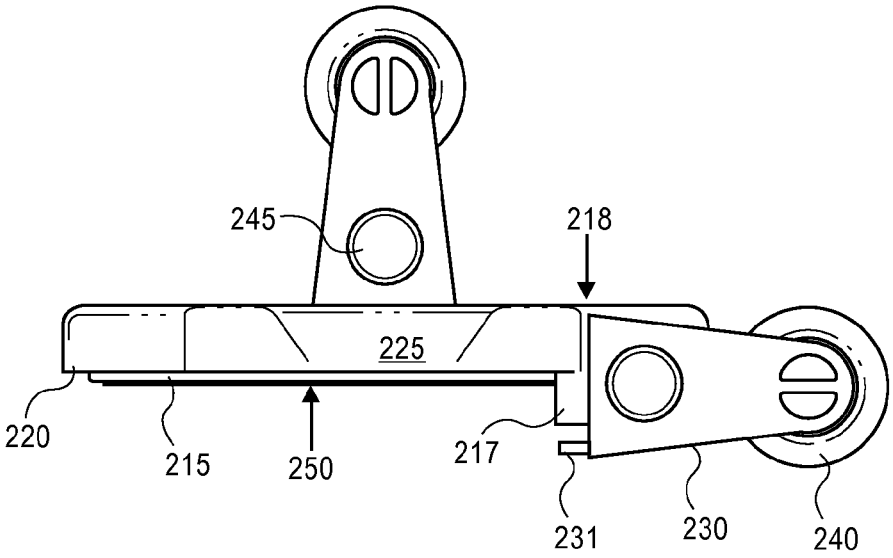
FIG. 7B is a side view of FIG. 7A to show the relation of the handle assembly 210 to the base support 215 in further detail.

FIG. 7A is a top view showing how a handle 240 is configured in preparation for storage; FIG. 7B is a side view of FIG. 7A to show the relation of the handle assembly 210 to the base support 215 in further detail. For purposes of clarity, the base support 215 has been removed to better show the interconnection of a handle assembly 210 from a front or rear facing of a given handle support structure 220. In particular, once removed from the lower base 222 of its corresponding handle support structure 220 by depressing the release mechanism, each support arm 230 of the handle assembly is inserted into corresponding slots at a junction 218. Each support arm 230 on the handle assembly includes a locking lug 217 which engages a corresponding slot (not shown) in the front or rear facing of the handle support structure 220 to enable a snap fit.

Figure 8A:
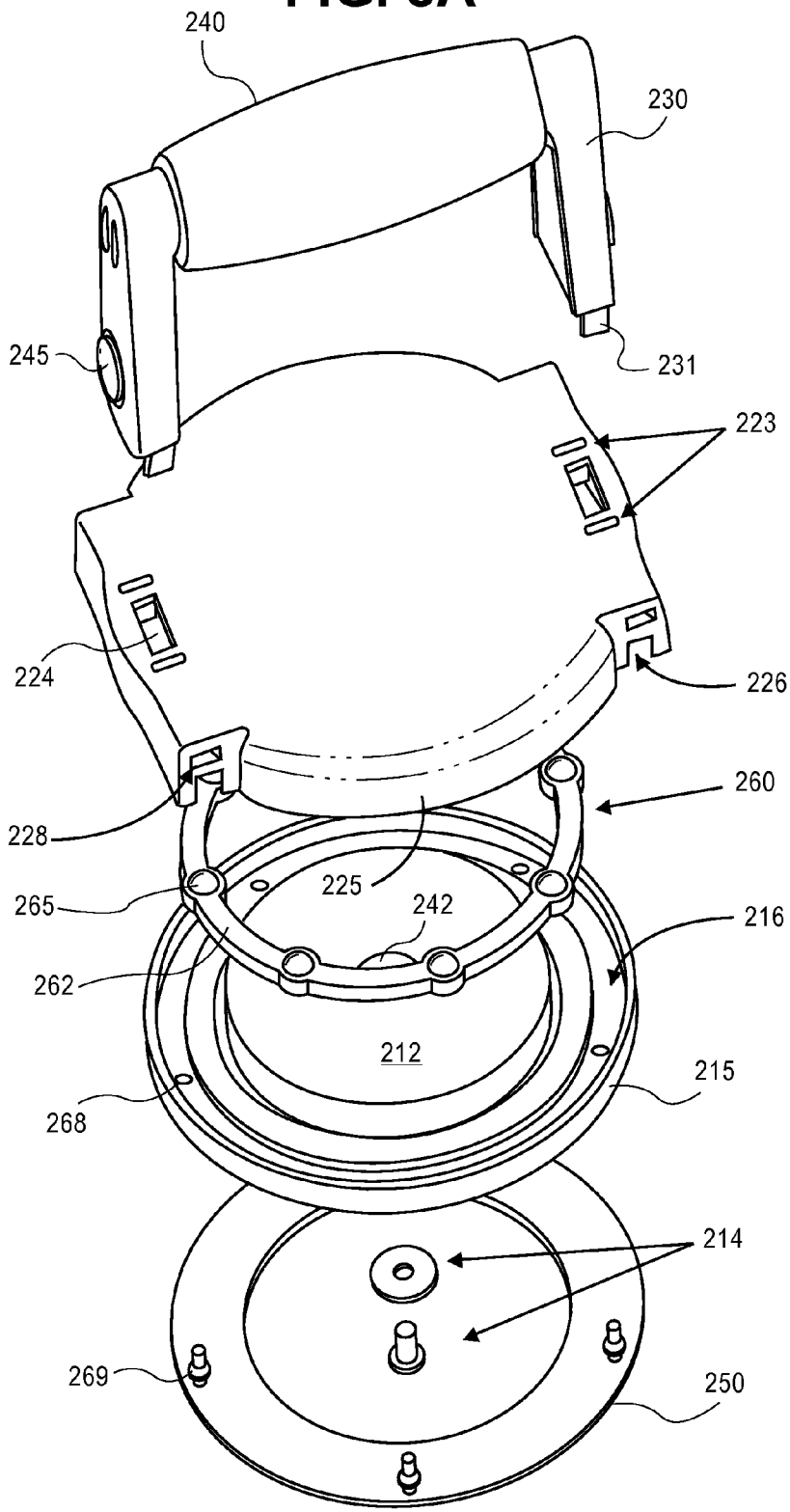
FIG. 8A is an exploded view of one device 200 of the pair to illustrate constituent components thereof in greater detail.

FIG. 8A is an exploded view of one device 200 of the pair to illustrate constituent components thereof in greater detail. Only one base support 215 and handle support structure 220 is shown, it being understood that in its stowed configuration, the two base supports 215 are sandwiched between the base support structures 220 which are locked together by the pair of handle assemblies 210. To assemble a given device 200, a handle assembly 210 is removed from the front or rear facings 225 of the base support structures 220. In particular, the user depresses both release mechanisms 245 to release the corresponding locking lugs 217 from the locking slots 226 formed in the facings 225 of the support structures 220, when the two base support structures are in a mating relationship to enclose the facing base supports 215.

As can be seen in FIG. 8A, each of the support arms 230 includes a central locking lug 217 arranged between two foot members 231. The handle assembly 210, once removed from the facings 223, then snaps into the lower base 222 of its corresponding handle support structure 220. In particular, the locking lug 217 engages a top locking slot 224 and the two feet 231 align with slots 223 so as to properly orient the handle assembly 210 on the lower base 222 of the handle support structure 220. This results in a secure snap fit, such that a lip of the lug 217 secures the support arm 230 within locking slot 224.

With continued reference to FIG. 8A, each device 200 includes a steel or hard plastic ball-bearing rotational system somewhat similar to that shown in FIG. 3, so to permit rotation between the upper portion of the device 200 and the base support 215. This system 260 includes a bearing ring or race 262 supporting a plurality of glass bearings 265 configured in spaced relation around a circumference thereof. The ball-bearing rotational system 260 is supported within a circular channel 216 of base support 215 around a center post 212 of the base support 215. The base support 215 includes a plurality of bores 268 which receive fasteners 269 to couple the base support 215 to the rotatable handle support structure 220 (corresponding receiver bore holes not show; these are formed in the underside of handle support structure 220). The center post 212 has a central aperture 242 to receive fastening elements 214 which fasten the fixed base support 215 to the rotating contiguous handle support structure 220 and handle assembly 210 of the device 200. A rubber ring pad 250 is adhered to the bottom of base support 215 to provide a friction surface.

Figure 8B:
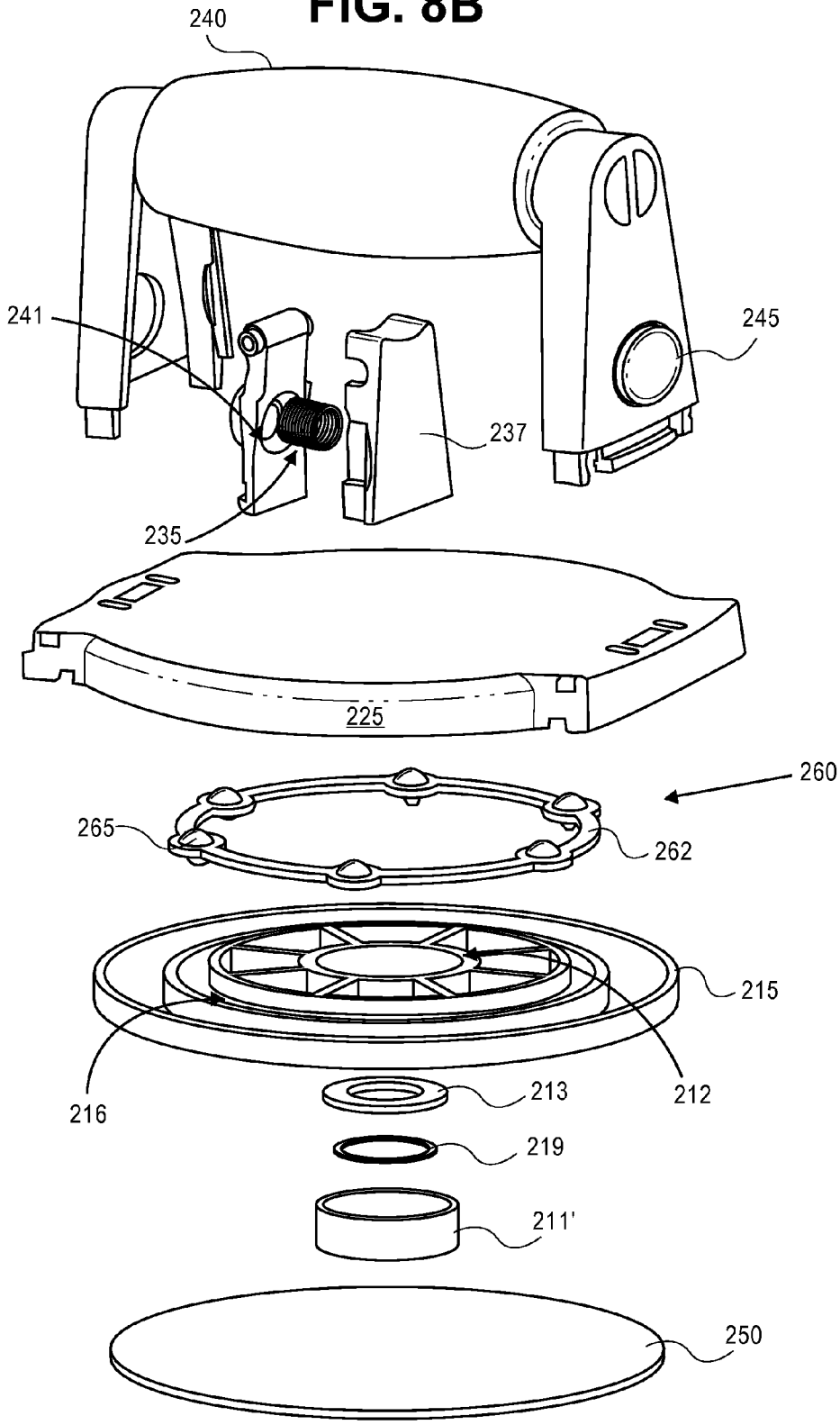
FIG. 8B illustrates an alternative construction of the lower portion of device 200.

FIG. 8B illustrates an alternative construction of the lower portion of device 200, only the differences from FIG. 8A are described in detail. In FIG. 8B, the bearing race 262 containing glass bearings 265 seats in channel 216 of base support 215. However, instead of a rubber ring 250 adhered to the underside of base support 215, and the fastening means 214 (screw/washer) connected base support 250 to handle support structure 220 via a bore through center post 212, the example of FIG. 8B employs a full size rubber pad 250' attached to the bottom of base support 215 with adhesive. There is also a washer 213 and a retainer ring 219 enclosed by a fixed cap 211 which seats within the interior of the center post 212.

Figure 9:
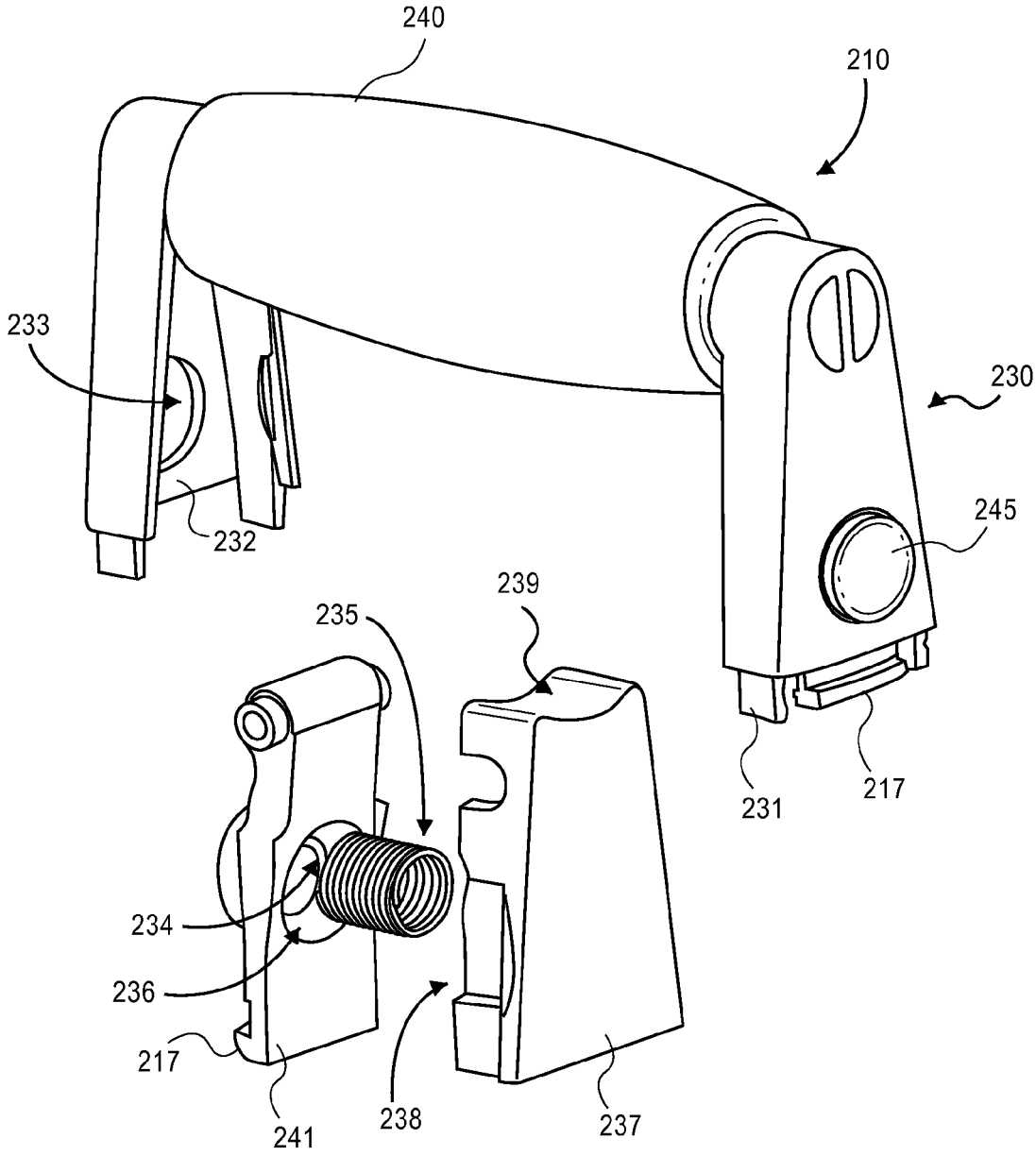
FIG. 9 is a partial exploded view of the handle 240 and support arm 230 of the handle assembly 210 to further detail the components comprising the release mechanism 245.

FIG. 9 is a partial view of the handle 240 and support arm 230 of the handle assembly 210 to further describe components comprising the release mechanism 245. Each support arm 230 includes an outer sidewall 232 having an aperture there through to receive the release mechanism 245, which is shown as a spring actuated button 245. Each support arm 230 terminates from its apex to its bottom into two feet 231 to be received in one of slots 223 in the lower base 222 of the handle support structure 220, or into slots 228 on the facings 225 of the front or rear of the handle support structure 220 if the push-up unit is to be configured for stowage.

Each support arm 230 includes a central member 241 between the outer sidewall 232 and an inner sidewall 237. The central member 241 has an aperture 236 which aligns with aperture 233 in the outer sidewall 232 so as to receive a post 234 of the release mechanism 245. The post 234 contacts a compression spring 235 to compress the spring 235 against a counter force provided by the wall surface (shown generally at 238) of the inner sidewall 237. The central member 241 terminates at its lower end as the locking lug 217. The top surface 239 of inner sidewall 237 is shaped so as to mate flush with the rounded outer surface of handle 240.

Figure 10:
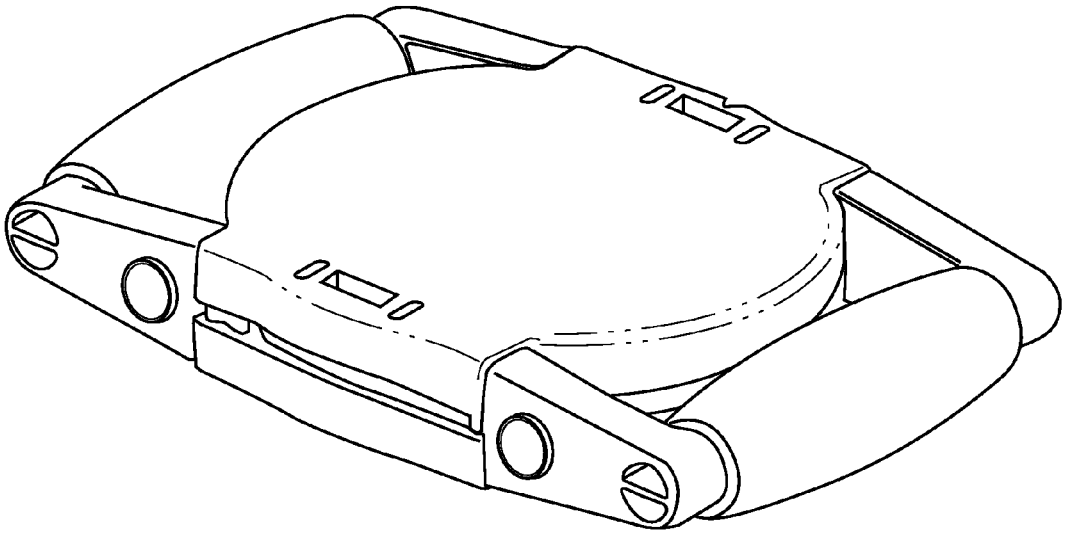
FIG. 10 is a perspective view of the complete push-up unit configured for stowage.

FIG. 10 is a perspective view of the complete push-up unit configured for stowage. As shown, the generally flat, compact design enables the unit to be stowed for travel, for example. The two handle assemblies 210 interconnect between the facing base support structures 220 so as to secure the base support structures 220 and corresponding base supports 215 together. The push-up exercise unit comprising devices 200 thus provides a small, lightweight embodiment that can be disassembled and stowed for travel. This enables the user to more easily store and transport the unit when going on trips.

The example embodiments being thus described, it will be obvious that the same may be varied in many ways. For example, the bearing systems in FIGS. 3 and 8 can be interchangeable between devices 100, 200. Further, instead of forming separate end caps 130 and handle support structure 120, the housing could be a single molded article. Such variations are not to be regarded as departure from the example embodiments, and all such modifications as would be obvious to one skilled in the art are intended to be included herein.

What is claimed:

1. A push-up exercise unit, comprising:

a pair of rotatable devices, one for each hand, each device including:

a handle support structure configured as a single molded housing and including a lower base and a pair of spaced-apart columns sloping upward from the lower base so that upper portions of the columns engage corresponding top end caps attached at ends of a handle assembly there between, such that a handle of the handle assembly intersects a corresponding end cap and upper portion of a corresponding column, wherein the end cap and upper portion have a semi-circular recess which mate to form a circular aperture around a corresponding handle end to secure the handle to the handle support structure, and wherein each column has a central stanchion extending between a pair of posts to be received in its corresponding end cap, a fixed base support operatively attached to the handle support structure, and a bearing assembly operatively attached within the housing of the handle support structure to permit rotation of the contiguous handle, end caps and handle support structure by a user with the base support resting on a planar surface.

2. The unit of claim 1, wherein each of the base support, handle support structure and end caps is an injection molded article.

3. The unit of claim 1, wherein the handle assembly includes a hollow, metal handle-rod sheathed within a rubberized grip.

4. The unit of claim 3, wherein the rubberized grip has a length shorter than the metal handle-rod to expose metal between the ends of the grip and the end caps.

5. The unit of claim 3, wherein a first diameter of the grip is wider at a grip center than a second diameter at the grip ends.

6. The unit of claim 1, wherein the base support has a rubber pad adhered to an underside thereof to provide a friction surface when the device is resting on a flat surface.

7. The unit of claim 1, wherein each handle end has a chamfer, the stanchion on each column engages its corresponding chamfer to secure the handle to the handle support structure, and each end cap has a pair of bores provided in an interior surface thereof to receive the posts of its corresponding column so that a handle end is enclosed between the end cap and column of the handle support structure.

8. A push-up exercise device, comprising:

a single molded housing having a circular lower base and an integral downwardly extending facing formed around a circumference of the lower base, the housing including a pair of facing columns sloping upward from the lower base to form part of the circumferential facing, a top end cap attached to either side of the handle and to an upper portion of a corresponding column such that each handle end intersects a corresponding end cap and column upper portion of the housing, wherein the end cap and upper portion have a semi-circular recess which mate to form a circular aperture around a corresponding handle end to secure the handle to the housing a fixed base support operatively attached to the housing and partially enclosed within the downwardly extending circumferential facing of the lower base, and a bearing assembly operatively attached within the housing to permit rotation of the contiguous handle, and housing by a user with the fixed base support resting on a planar surface.

9. The device of claim 8, wherein the handle is composed of a handle-rod sheathed within a rubberized grip that has a length shorter than the handle-rod to expose a portion of the handle-rod between the ends of the grip and the end caps.

10. The device of claim 9, wherein a first diameter of the grip is wider at a grip center than a second diameter at the grip ends.

11. The device of claim 8, wherein each column includes a central stanchion extending between a pair of posts to be received in its corresponding end cap.

12. The device of claim 11, wherein each handle end has a chamfer, the stanchion on each column engages its corresponding chamfer to secure the handle to the handle support structure, and each end cap has a pair of bores provided in an interior surface thereof to receive the posts of its corresponding column so that a handle end is enclosed between the end cap and column of the housing.

* * * * *

UNITED STATES PATENT AND TRADEMARK OFFICE

CERTIFICATE OF CORRECTION

PATENT NO. : 7,468,025 B2
APPLICATION NO. : 11/996152
DATED : December 23, 2008
INVENTOR(S) : Hauser et al.

It is certified that error appears in the above-identified patent and that said Letters Patent is hereby corrected as shown below:

Column 1, line 41 and line 53, "is perspective view" should read --is a perspective view--.

Column 2, line 4, "is perspective view" should read --is a perspective view--; line 31, "instead of, or in addition with ABS" should read --instead of or in addition with ABS.--.

Column 3, line 67, "post 126" should read --post 127--.

Column 4, line 2, "there is a provided a semi-circular recess" should read --there is provided a semi-circular recess--; lines 26-28, "Examples of such natural arc of movement include throwing a punch, swinging a golf club, or pressing dumbbells, for example" should read --Examples of such natural arcs of movement include throwing a punch, swinging a golf club, or pressing dumbbells.--; line 36, "Fig. 6 is perspective view" should read --Fig. 6 is a perspective view--; line 60, "an lower base 222" should read --a lower base 222--.

Column 5, line 33, "facings 223" should read --facings 225--.

Column 6, line 36, "to more easily store and transport the unit" should read --to store and transport the unit more easily--.

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,468,025 B2
APPLICATION NO. : 11/996152
DATED : December 23, 2008
INVENTOR(S) : Stephen G. Hauser, Mark B. Friedman and Alden Morris Mills It is certified that error appears in the above-identified patent and that said Letters Patent is hereby corrected as shown below:

On the Title Page

Please insert the following under Item (87):

--Related U.S. Application Data
(60) Provisional application No. 60/817,109, filed on Jun. 29, 2006.--

Signed and Sealed this
Twenty-seventh Day of September, 2011

David J. Kappos

David J. Kappos
*Director of the United States Patent and Trademark Office*